US005662499A

United States Patent [19]

Strack et al.

[11] Patent Number: 5,662,499

[45] Date of Patent: Sep. 2, 1997

[54] ELECTRICAL TERMINAL STRIP

[75] Inventors: Holger Strack, Bamberg; Gerhard Kubernus, Hirschaid-Sassanfahrt, both of Germany

[73] Assignee: F. Wieland Elektrische Industrie GmbH, Bamberg, Germany

[21] Appl. No.: 536,252

[22] Filed: Sep. 29, 1995

[30] Foreign Application Priority Data

Oct. 1, 1994 [DE] Germany ..... 9415801 U

[51] Int. Cl.[6] ..... H01R 9/22

[52] U.S. Cl. ..... 439/709; 439/723

[58] Field of Search ..... 439/709, 712–718, 439/722, 723

[56] References Cited

U.S. PATENT DOCUMENTS 5,407,367 4/1995 Robertson ..... 439/715
5,411,417 5/1995 Horn et al. ..... 439/709

FOREIGN PATENT DOCUMENTS 42 28 025 3/1994 Germany .
42 07 402 5/1994 Germany .

*Primary Examiner*—Khiem Nguyen
*Attorney, Agent, or Firm*—Spencer & Frank

[57] ABSTRACT

An electrical terminal strip for potential multiplication includes an insulating terminal housing having a plurality of openings arranged in a row. A comb yoke extends in a direction of the row, and is located within the terminal housing. At least one terminal contact row is located in the insulating terminal housing, and includes a plurality of contact connections disposed side by side in the direction of the row. Each contact connection includes a conductor terminal element having a receiving space therein. Each receiving space is in registration With a respective terminal housing opening, and extends in a direction approximately perpendicular to the direction of the row. The receiving spaces receive respective protective conductors inserted from an outside of the terminal housing and through the respective terminal housing opening. Each contact connection further includes a conductor protecting element inserted into the respective receiving space. Each conductor protecting element is attached to the comb yoke to collectively form a one-piece comb-Shaped contact bar for electrically connecting the contact connections of the at least one terminal contact row to one another. The conductor protecting elements form the prongs of the comb-shaped contact bar. The conductor is clampable between the conductor protecting element and the conductor terminal element to contact the conductor protecting element and the conductor terminal element. At least one connector pin protrudes out from the terminal housing and is electrically connected to a contact connection.

12 Claims, 2 Drawing Sheets

ELECTRICAL TERMINAL STRIP

CROSS-REFERENCE TO RELATED APPLICATIONS

This application claims the priority of German Application No. G 94 15 801.0 filed on Oct. 1, 1994, which is incorporated herein by reference.

BACKGROUND OF THE INVENTION

The present invention relates to an electrical terminal strip for potential multiplication. The electrical terminal strip includes an insulating terminal housing having a plurality of openings arranged in a row. At least one terminal contact row is located in the insulating terminal housing. The terminal contact row has a plurality of contact connections disposed side by side in the row direction. Each contact connection includes a conductor terminal element having a receiving space located therein. Each receiving space is in registration with a respective terminal housing opening, and extends in the direction approximately perpendicular to a direction of the row. The receiving spaces receive respective protective conductors inserted from an outside of the terminal housing and through the respective terminal housing openings. The contact connection further includes a conductor protecting element inserted into the respective receiving space. The protective conductor is clamped between the conductor protecting element and the conductor terminal element to contact the conductor protecting element and the conductor terminal element. At least one connector pin protrudes out from the terminal housing and is electrically connected to a contact connection.

German Offenlegungsschrift (application published without examination) No. 42 28 025 discloses such a terminal strip for connection to printed circuit boards. The insulating terminal housing according to this publication contains a single terminal contact row that comprises a number of contact connections lined up one next to the other.

A soldered connector pin, which protrudes out from the terminal housing, is associated with each contact connection.

A conductor, which is inserted from the outside into the terminal housing, can be electrically connected to any of the contact connections. In doing so, the conductor is inserted into a receiving space of a respective conductor terminal element, which functions as a tension sleeve, and clamped firmly between a clip-like conductor protecting element and the conductor terminal element.

The conductor protecting element is likewise disposed in the receiving space of the conductor terminal element and is connected in one piece to the soldered connector pin. The firmly clamped conductor is therefore connected to the associated soldered connector pin in an electrically conductive manner.

If a potential multiplication is desired, as is required in many cases such as with protective conductors, the relevant soldered connector pins have to be connected to one another independently of the printed circuit. To accomplish this, typically a connection bar is provided, which extends in the direction of the row of contact connections, and which is slipped onto the soldered connector pins from the outside of the terminal housing to engage the soldered connector pins with electrically contacting clamping pressure.

A disadvantage associated with this connection bar is that the connection bar must be subsequently placed on the terminal housing as a separate element, and consequently, requires additional assembly of the terminal strip.

Further, since the connection bar is slipped onto the soldered connector pins from the outside of the housing, and remains on the outside of the housing even in an assembled condition, the connection bar is not protected against external influences. The connection bar can therefore be easily mechanically damaged.

In addition, an outer region of the connection bar can inadvertently come into contact with, for example, a current-carrying conductor and as a result, can cause a short circuit or other damage to elements of the printed circuit board. Thus, potential multiplication using the aforementioned connection bar may be unsafe.

A Further disadvantage of the known connection bar is that the connection bar needs a complicated geometrical shape to produce a sufficient, electrically contacting clamping pressure between the connection bar and the soldered connector pins. Consequently, the production cost of the terminal strip is high.

German Patent No. 42 07 402 discloses a terminal strip for electrically connecting actuators, sensors, initiators, or the like to printed circuit boards of an SPC (=stored program control) plug-in unit. This known terminal strip contains a plurality of terminal contact rows. For potential multiplication, the contact connections of a terminal contact row can be connected using a covered, internal bridge located inside the terminal housing.

SUMMARY OF THE INVENTION

It is an object of the present invention to provide a terminal strip for potential multiplication that is completely safe and simple to manufacture.

The above and other objects are accomplished according to the invention by the provision of a comb yoke that extends in the direction of the row, and that is located Within the terminal housing. Each conductor protecting element is attached to the comb yoke to collectively form a one-piece comb-shaped contact bar for electrically connecting the contact connections of the terminal contact row to one another. The conductor protecting elements form the prongs of the comb-shaped contact bar.

According to the invention, separate elements for potential multiplication are avoided. Since the comb yoke, which produces the potential multiplication, is an integral component of the contact bar, the potential multiplication is obtainable without requiring additional assembly steps of the terminal strip, since the conductor protecting elements have to be inserted into the receiving spaces anyway.

In the final assembled state, the comb yoke is disposed inside the terminal housing, and as a result, is protected against inadvertent mechanical damage and unintentional electrical contacts.

In terms of manufacture, the contact bar can be easily produced as a one-piece element. In addition, contact resistances between the conductor protecting elements and the comb yoke are prevented. Further, the electrical contacting of the conductor protecting elements lined up in a row is reliably maintained.

Regarding its manufacture, the contact bar can be easily produced from a metal strip because of its comb-like shape. For example, the shape of the contact bar can be stamped from a blank to form an endless strip. To provide a potential multiplication with various numbers of contact connections in the row direction, the endless strip is simply cut to the appropriate length. Therefore, the same stamping tool can be used for producing various length contact bars, so that potential multiplication using various numbers of contact connections can be easily obtained. Further, contact bars made in the aforementioned manner are easy to store.

The contact bar according to the invention can be used in terminal strips having a single terminal contact row, or a plurality of terminal contact rows. Thus, for example, terminal strips with three or four terminal contact rows, suitable for connection to sensors, initiators, or the like, can be produced. Potential multiplication can then be provided for the two terminal contact rows associated with the positive and negative connections and, if need be, also for the terminal contact row associated with the protective conductors. The terminal contact row associated with the sensor-specific signals is not normally given any potential multiplication.

Typically, the contact bar has an L-shaped cross sectional profile. As a result, the contact bar can be installed in the terminal housing in a space-saving manner. To form the L-shape, the conductor protecting element and the comb yoke are bent at a right angle relative to one another from the above-mentioned strip. The required bending procedure can be easily accomplished from a manufacturing standpoint.

Preferably, a connector pin is formed in one piece with the contact bar, that is, connected in a mechanically stable manner. Thus, unwanted contact resistances between the connector pin and a respective conductor protecting element are reduced or prevented. Further, the electrical contact between the connector pin and a clamped-in conductor cannot be inadvertently broken. This guarantees the reliable operation of the terminal strip.

The production of a contact bar with one or a plurality of connector pins can be accomplished in a simple manner. In fact, it is sufficient for purposes of potential multiplication to provide the contact bar with only a single connector pin, such as a soldered connector pin for a printed circuit board, since, for example, the positive or negative voltage need only be picked up at a single strip conductor of the printed circuit board for distribution by the contact bar to the conductor protecting elements. Further, in the potential multiplication for the protective conductors, it may be necessary that only one connector pin be associated with all contact connections, since otherwise the protective conductor may disadvantageously be connected in a loop via the strip conductors of the printed circuit board. With a contact bar having a plurality of connector pins, the connector pins form the prongs of a connector comb. Each contact connection will thus adjoin a respective connector pin. In such a contact bar, a single manufacturing tool can be used for all types of terminal strips or printed circuit boards.

If the connector pins and the comb yoke are located in the same plane, installation Space is reduced, and the manufacture of the contact bar is simplified.

Preferably, the contact bar is inserted from inside the terminal housing and into the receiving space of the conductor terminal element. Therefore, the contact bar is not accessible from the outside, and is protected against mechanical damage and inadvertent electrical contacts. Only the connector pins protrude out from the terminal housing.

Advantageously, the contact bar, once inserted within the terminal housing, is fixed in a mechanically stable manner. Thus, inadvertent position changes of the contact bar are prevented, and consequently, inadvertent breakage of the electrical contact between the contact bar and the conductor inserted into the contact connection is prevented. Preferably, an easy-to-assemble detent connection is provided for mechanically fixing the contact bar in position.

The detent recesses provided in the comb yoke of the contact bar for the detent connection can be produced, for example, by stamping during the same work step with which the comb-shape of the contact bar is produced. For a consistently stable securement of the contact bar along the entire terminal contact row, the detent recesses are evenly spaced in the row direction.

Preferably, the terminal housing, which is comprised of, for example, insulating plastic, includes a plurality of housing layers for widening and narrowing the terminal housing in the row direction in a building-block fashion. In this manner, with a low number of terminal housing layers, and even with a single terminal housing layer, the terminal strip can be adapted to various printed circuit board types and/or mating strips. As a result, the terminal housings can be made in a cost-effective manner and with the same tool. Further, the storage and procuring of replacement parts for the terminal housing are simplified.

The assembly of the individual layers of the terminal housing can be easily accomplished, even by laymen. The housing layers can be simply assembled, for instance, using a tongue-and-groove connection.

The invention will be described below in greater detail in connection with an embodiment thereof that is illustrated in the drawing figures.

DETAILED DESCRIPTION OF THE PREFERRED EMBODIMENTS

Figure 1:
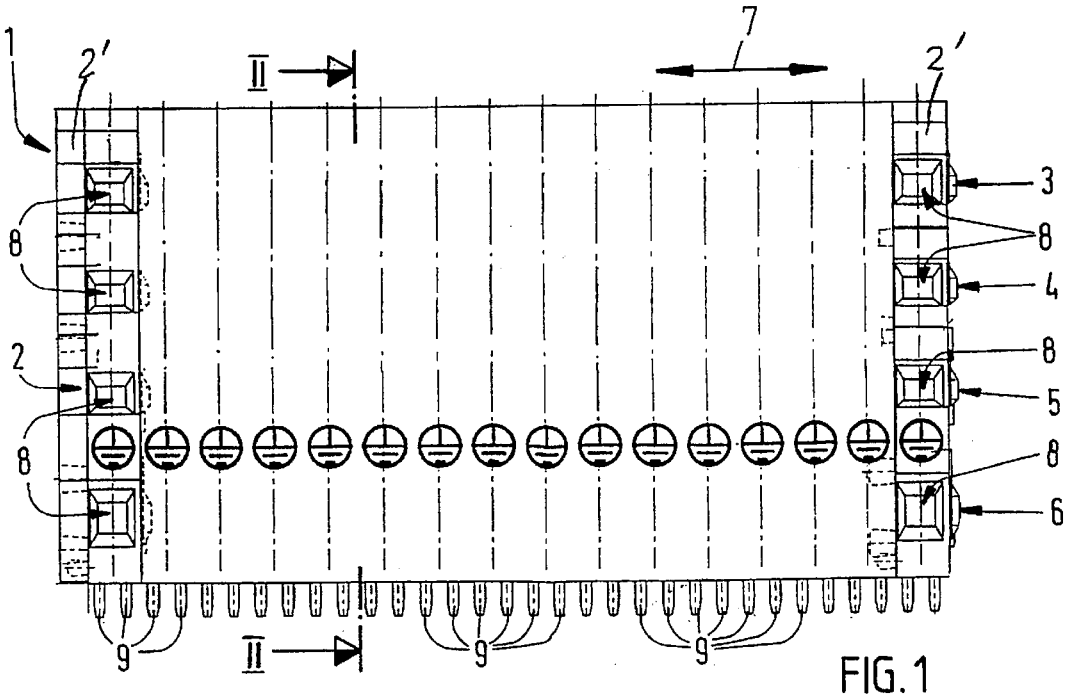
FIG. 1 is a front elevational view of a terminal strip according to the invention.

Referring to FIG. 1, an electrical terminal strip 1 for potential multiplication is illustrated. The potential multiplication is schematically illustrated in FIG. 1.

The electrical terminal strip 1 has a terminal housing 2 made of insulating plastic. As shown, a front outline of the terminal housing 2 can be, for example, rectangular in shape.

A plurality of terminal contact-rows 3, 4, 5, 6 are inserted into the terminal housing 2. In this embodiment, four terminal contact rows 3, 4, 5, 6 are illustrated. Each terminal contact row 3, 4, 5, 6 extends parallel to one another in a row direction 7. Further, each terminal contact row 3, 4, 5, 6 comprises a plurality of contact connections 8 lined up one next to the other in the row direction 7. For the sake of clarity, only the contact connections a located on extreme opposite ends of the terminal housing 2 are shown.

A soldered connector pin 9 is associated with each contact connection 8. The connector pins 9 are all aligned in the row direction 7, and protrude out from the terminal housing 2 in a plug-in direction 10. The terminal strip 1 is pressed onto a printed circuit board (not shown) in plug-in direction 10, so that the soldered connector pins 9 are plugged into the metallized solder eyes of the printed circuit board.

Each contact connection 8 comprises a terminal screw 11, a conductor terminal element 12 screwed to the terminal screw 11, and a clip-like conductor protecting element 13.

The conductor terminal element 12 defines a receiving space 14, 14' therein, which extends in an insertion direction 15 and, which is in registration with an introduction opening 16 of the terminal housing 2. Further, the conductor protecting element 13 extends approximately in an insertion direction 15, which is perpendicular to the row direction 7 and perpendicular to the plug-in direction 10.

In use, a conductor 24 (shown only in phantom lines) is inserted in the insertion direction 15 into introduction opening 16 of the terminal housing 2, and into receiving space 14, 14'. To facilitate the insertion of conductor 24, introduction opening 16 flares outwardly. By actuating the terminal screw 11, the conductor 24 can be firmly clamped between the conductor terminal element 12 and the conductor protecting element 13 to electrically contact the conductor terminal element and the conductor protecting element. The structural design and function of the contact connection 8 is described in the earlier-mentioned German Offenlegungsschrift No. 42 28 025, and will accordingly not be described in further detail.

Figure 2:
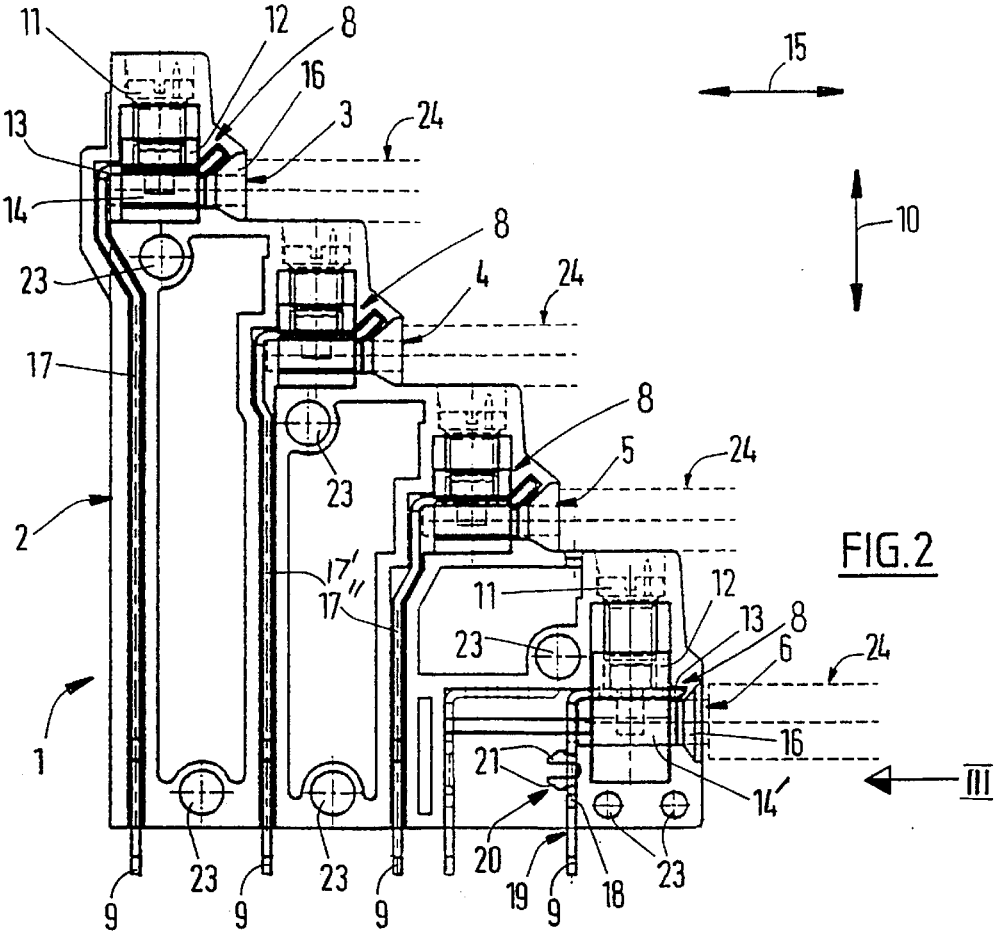
FIG. 2 is a sectional view taken along line II—II.

In FIG. 2, the cross section of the terminal housing 2 is stepped. Each step is associated with one terminal contact row 3, 4, 5, 6.

As noted in FIG. 2, contact rows 3, 4, and 5 are similarly configured. Each soldered connector pin 9 is connected to a respective associated conductor protecting element 13 of a respective terminal contact row 3, 4, 5 by a metallic connecting rib 17, 17', 17" to form a single piece. The connecting ribs 17, 17', 17" extend essentially in the plug-in direction 10, and are inserted into corresponding slots in the terminal housing 2 with a positive fit. The conductor protecting elements 13 connected to the connecting ribs 17, 17', 17" are attached to the introduction opening 16 using a bent free end. The positive-fit insertion of the connecting ribs 17, 17', 17", the soldered connector pins 9, and the conductor protecting elements 13, fixes the terminal contact rows 3, 4, 5 in the terminal housing 2 in a mechanically stable manner.

Figure 4:
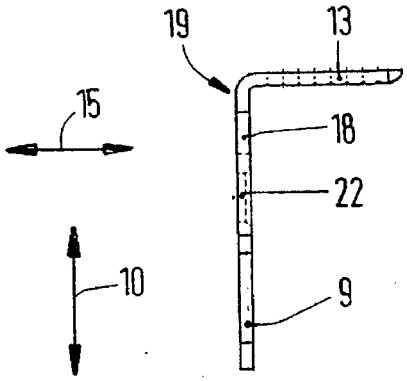
FIG. 4 is an enlarged view of the contact bar as seen in the direction of the arrow IV in FIG. 3.

In contrast to the terminal contact rows 3, 4, 5, the terminal contact row 6 does not include a connecting rib 17. Instead, the soldered connector pins 9 and the conductor protecting elements 13 of the terminal contact row 6 are integrally connected to each other to form an L-shape; that is, the conductor protecting elements 13 and the soldered connector pins 9 are connected together to form a 90° angle therebetween, as is illustrated in FIG. 4. As shown in this Figure, the two legs of the L, that is, the soldered connector pins 9 and the conductor protecting elements 13 are formed to each other about an axis that extends in the row direction 7.

Figure 5:
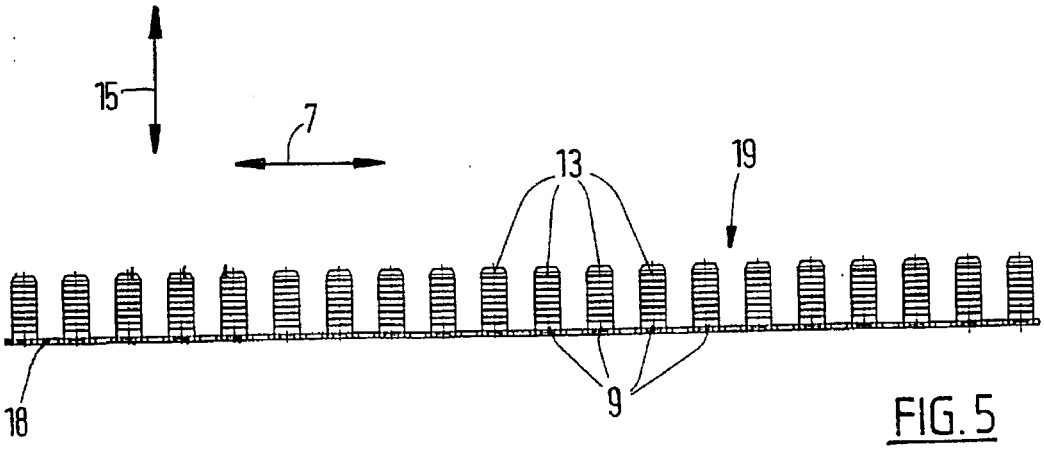
FIG. 5 is a view of the contact bar as seen in the direction of the arrow V of FIG. 3.

Referring also to FIG. 5, for potential multiplication, all conductor protecting elements 13 of the terminal contact row 6 are connected to each other by a comb yoke 18 to form a single piece. Comb yoke 18 extends in the row direction 7. The conductor protecting elements 13 and the comb yoke 18 together form a comb-shaped contact bar 19.

Figure 3:
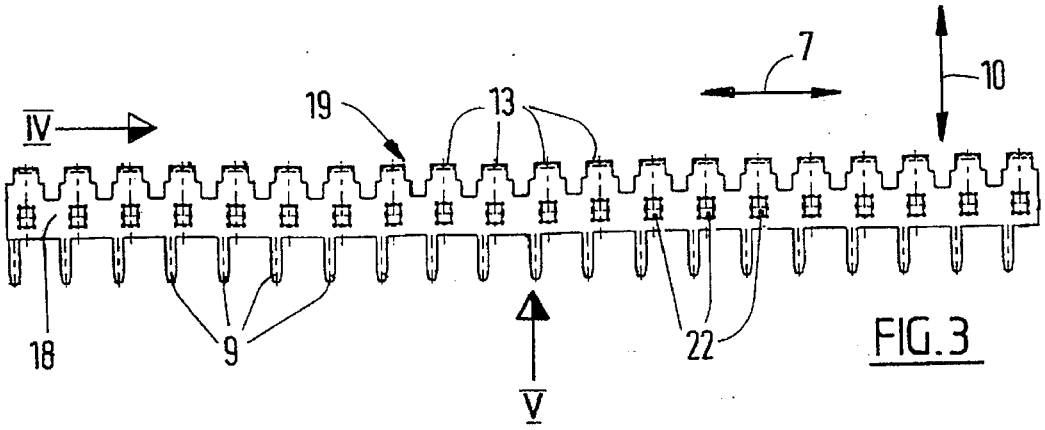
FIG. 3 is a view of a contact bar according to the invention, as seen in the direction of the arrow III in FIG. 2.

As shown in FIG. 3, the soldered connector pins 9 are attached, to form a one-piece element, on a side of the comb yoke 18 opposite the conductor protecting elements 13, to extend in the plug-in direction 10 (FIG. 3). In the 20-pole contact bar 19 shown in FIG. 3, one soldered connector pin 9 is associated with each conductor protecting element 13. Therefore, the soldered connector pins 9, together with the comb yoke. 18, likewise form a comb-shaped element that constitutes a portion of the comb-shaped contact bar 19.

The soldered connector pins 9 function as prongs, and are disposed, together with comb yoke 18, in a single plane that extends in the plug-in direction 10 and row direction 7.

To install the contact bar 19 into the terminal housing 2, the contact bar is inserted in the plug-in direction 10 though the bottom of the terminal housing. This position is shown in FIG. 2 by the dashed depiction of the contact bar 19. Once in this position, the contact bar 19 is moved in the insertion direction 15 and into the receiving spaces 14, 14'.

The contact bar 19 is locked in position by engaging the contact bar with detent protrusions 20, Which formed a single piece with the terminal housing 2. Each detent protrusion 20 has an approximately U-shaped cross sectional profile (FIG. 2), with the legs of the U being formed by two spring struts 21 extending approximately in the insertion direction 15. As shown in FIG. 3, the comb yoke 18 includes a plurality of rectangular detent recesses 22 extending therethrough in the insertion direction 15, for engagement with corresponding detent protrusions 20, so that the comb yoke 18 is fixed in place within the terminal housing 2. As shown, a detent recess 22 is associated with each conductor protecting element 13. Thus, when inserted, the contact bar 19 is fixed in a mechanically stable manner.

As shown in FIG. 2, the receiving spaces 14' of terminal contact row 6 are larger than the receiving spaces 14 of the other terminal contact rows 3, 4, 5. Typically, the terminal contact row 6, with the contact bar 19, is provided for the clamped contact of protective conductors (having a 2.5 $mm^2$ cross section, for example), while the other terminal contact rows 3, 4, 5, are typically associated with two supply lines and a signal line (having a 1.5 $mm^2$ cross section, for example) of a sensor.

The terminal housing 2 is formed of a plurality of layers 2' arranged in the row direction 7. Adjacent housing layers 2' are attached together with a tongue-and-groove connection. In addition, cylindrical plug-in pegs 23 (FIG. 2), which extend in the row direction 7, are formed on one side of each housing layer 2', while recesses (not shown), which are in registration with the plug-in pegs 23, are provided on the other side of each housing layer.

In the row direction 7, one housing layer 2' per contact connection 8 per terminal contact row 3, 4, 5, 6 is used, i.e., in the embodiment shown, each housing layer has four contact connections arranged in a column.

In the exemplary embodiment shown, the construction of the connecting ribs 17, 17', 17" and the conductor protecting elements 13 associated with these connecting ribs differs from the L-shaped construction of the contact bar 19 of terminal contact row 6. However, if desired, the conductor protecting elements 13 associated with the supply lines, for example a positive connecting line and/or of a negative connecting line, can likewise be components of an L-shaped contact bar. The connecting ribs 17 (or 17', 17"), which are lined up next to each in the row direction 7, can therefore be connected to each other in one piece (not shown).

In a further exemplary embodiment, the connecting ribs 17, 17', 17" of the terminal contact rows 3, 4, 5 can also be locked in detent fashion to the terminal housing 2, in the same previously described manner as the comb yoke 18.

It will be understood that the above description of the present invention is susceptible to various modifications, changes and adaptations, and the same are intended to be comprehended within the meaning and range of equivalents of the appended claims.

What is claimed is:

1. An electrical terminal strip for potential multiplication, comprising:

(A) an insulating terminal housing having a plurality of openings arranger in a row;

(B) a comb yoke extending in a direction of the row, end being located within said terminal housing;

(C) at least one terminal contact row located in the insulating terminal housing, and having a plurality of contact connections disposed side by side in the direction of the row, each said contact connection comprising:

(1) a conductor terminal element having a receiving space therein, each receiving space being in registration with a respective terminal housing opening, and extending in a direction approximately perpendicular to the direction of the row, the receiving spaces receiving respective conductors, for example protective conductors inserted from an outside of said terminal housing and through the respective terminal housing opening; and (2) a conductor protecting element inserted into the respective receiving space; each said conductor protecting element being attached to said comb yoke to collectively form a one-piece comb-shaped contact bar for electrically connecting said contact connections of said at least one terminal contact row to one another, said conductor protecting elements forming the prongs of said comb-shaped contact bar; means for clamping the conductor between said conductor protecting element and said conductor terminal element to contact said conductor protecting element and said conductor terminal element; and (D) at least one connector pin protruding out from terminal housing and being electrically connected to a contact connection.

2. The terminal strip according to claim 1, wherein said conductor protecting elements are arranged to form an approximate right angle with said comb yoke about an axis extending in the direction of the row.

3. The terminal strip according to claim 1, wherein said connector pin is formed in one piece to a side of said comb yoke opposite said conductor protecting elements.

4. The terminal strip according to claim 3, wherein said at least one connector pin comprises a plurality of connector pins each adjoining a respective contact connection, said connector pins forming the prongs of a connector comb.

5. The terminal strip according to claim 4, wherein each contact connection of said at least one terminal row adjoins a respective connector pin.

6. The terminal strip according to claim 4, wherein said connector pins and said comb yoke are located in a single plane.

7. The terminal strip according to claim 1, further comprising means for inserting said contact bar from the inside of said terminal housing into the respective receiving spaces.

8. The terminal strip according to claim 1, further comprising means for detent locking said contact bar to said terminal housing.

9. The terminal strip according to claim 8, wherein said means comprises a plurality of detent recesses spaced apart from one another in the row direction and penetrating said comb yoke, and a plurality of detent protrusions formed on said terminal housing to engage in corresponding detent recesses.

10. The terminal strip according to claim 1, wherein said terminal housing comprises a plurality of housing layers plugged together in the direction of the row.

11. The terminal strip according to claim 10, wherein each housing layer is associated with a respective contact connection.

12. The terminal strip according to claim 1, wherein said at least one connector pin is a soldered connector pin for printed circuit boards.

* * * * *